US006186637B1

(12) United States Patent
Murrietta

(10) Patent No.: US 6,186,637 B1
(45) Date of Patent: Feb. 13, 2001

(54) BABY BOTTLE WITH LIGHT AND SOUND AMUSEMENT FEATURES

(75) Inventor: Cecil B. Murrietta, Tustin, CA (US)

(73) Assignees: Cecil R. Murrietta; Irma Y Murrietta, both of Tustin, CA (US)

( * ) Notice: Under 35 U.S.C. 154(b), the term of this patent shall be extended for 0 days.

(21) Appl. No.: 09/073,293

(22) Filed: May 6, 1998

(51) Int. Cl.[7] ..... F21W 131/00
(52) U.S. Cl. ..... 362/101; 362/96; 362/806
(58) Field of Search ..... 362/101, 96, 806

(56) References Cited

U.S. PATENT DOCUMENTS 2,582,781 * 1/1952 Johnson ..... 362/101 X
2,745,947 * 5/1956 Sansous ..... 362/101 X
5,010,461 * 4/1991 Saotome ..... 362/101
5,044,509 * 9/1991 Petrosky et al. ..... 362/101 X
5,339,548 * 8/1994 Russell ..... 362/101 X
5,344,034 9/1994 Eagan ..... 215/11.1
5,662,406 9/1997 Mattice et al. ..... 362/101

* cited by examiner

*Primary Examiner*—Laura K. Tso
(74) *Attorney, Agent, or Firm*—Gene Scott-Patent Law & Venture Group

(57) ABSTRACT

The present invention is a combination baby bottle and amusement device. The baby bottle has a hollow cylindrical body and a bladder that holds the feeding liquid. The device is adapted to frictionally fit into an open end of the cylinder opposite a feeding nipple. The device projects light beams into the liquid filled bladder and also produces a sound show. The device projects a single or multiple light beams that change color, shape, intensity, and blink synchronously with time. The light and sound show entertain the baby while it is feeding and may also pacify and arouse the baby.

15 Claims, 3 Drawing Sheets

BABY BOTTLE WITH LIGHT AND SOUND AMUSEMENT FEATURES

BACKGROUND OF THE INVENTION

1. Field of the Invention

This invention relates generally to bottles for feeding an infant or baby, and more particularly to a combination baby bottle and amusement device that provides a random light and sound show for a baby while feeding.

2. Description of Related Art

The following art defines the present state of this field:

Mattice et al., U.S. Pat. No. 6,662,406 describes a baby bottle having a bottle portion with a first proximal end and a second distal end relative a feeding baby, a nipple portion attached to the bottle portion at the proximal end, a light member for illuminating the bottle attached to the distal end of the bottle portion and an attachment member for attaching the light member to the bottle. The light member includes a light source, a main power switch and a power source, all electrically connected together and mounted within a protective housing. The light member may also include an angle sensitive switch for activating the light source when the bottle is not upright.

Eagart, U.S. Pat. No. 5,344,034 describes an electronic musical adapter for removable attachment to a baby nursing bottle to produce a musical tune to soothe and amuse the baby upon movement of the bottle during the feeding process. The adapter comprising a cup-shaped housing, a melody producing circuit including an integrated circuit microchip within which is stored musical tune information, a battery power source, a buzzer-type speaker and a motion-activated microswitch for activating the microchip, and a wafer-like container encapsulating the melody producing circuit removably situated within the cup-shaped housing proximate the bottom thereof.

The prior art teaches both light and sound displays in a baby bottle. However, the prior art does not teach a miniature light and sound display means easily attached to a baby bottle and capable of various light displays into the baby bottle as well as sound displays in the manner shown in the present invention. The present invention fulfills these needs and provides further related advantages as described in the following summary.

SUMMARY OF THE INVENTION

The present invention teaches certain benefits in construction and use which give rise to the objectives described below.

Baby feeding bottles are commonly used for the sole purpose of providing a baby with nourishment. Some parents also use the baby bottle as a means to pacify the baby when the baby becomes irritated or upset. However, the baby often becomes disinterested or drowsy while feeding and begins to fall asleep. When the bottle is used as a pacifier, the baby will often reject it. The present invention teaches a light and sound producing device utilized in conjunction with a baby bottle to provide a means of entertainment for the baby to prevent the baby from falling asleep prematurely or rejecting the bottle when used as a pacifier.

The present invention is a combination baby feeding bottle and light and sound device. A baby bottle comprises a support portion, a bladder adapted to fit inside the support portion, a drinking nipple, and a bottle top used as a clamp for the bladder. A lighting device comprises a housing, a battery power supply, a light bulb, a reflector, a lens, a switch, a motorized light filter, and a buzzer device for producing sounds as driven by an integrated circuit. In one embodiment, the lighting device further comprises a motor with an extended shaft holding the light filter over the light bulb shaft. The light filter is multicolored, multi-textured, or a combination of both. The light bulb projects a light beam through the filter, thereby providing a means to change the light beam's color, shape, or a combination of both. The motor is controlled by the integrated circuit, thereby providing a means for producing constant or intermittent rotation of the motor shaft and second lens in accordance to a program stored within the integrated circuit. The constant rotation of the shaft and lens provides a means for changing the color or shape of the light beam with time. The integrated circuit also provides a means for periodic interruption of the light beam and for adjusting the light beam's intensity.

The lighting device is adapted to frictionally fit within the support portion. The light beam projected by the lighting device is reflected into the support portion and illuminates the bottle and the liquid contained within the bladder.

A primary objective of the present invention is to provide a means to entertain a baby with a light show while the baby is feeding, having advantages not taught by the prior art. The light show consists of one or more light beams projected by the lighting device into the bottle. The light show consists of light beams that change color, shape, intensity, and/or blink continuous with time. The light show provides a means to mesmerize and entertain the baby while it is feeding.

Another objective of the present invention is to provide a pacifying effect on the baby. When babies cry uncontrollably, parents commonly attempt to pacify the baby by resorting to a baby bottle. However, the baby is often disinterested and will not accept the bottle. The light show provided by the present invention arouses the baby's interest in the bottle. Prior art merely provides an object for the baby to suck on without providing an alternative to focus their attention. The light show provides an alternative for the baby's focus and therefore the light show has a pacifying affect.

A further objective of the present invention is to have an arousing effect on the baby. Babies have a tendency to become drowsy and fall asleep while feeding. Many parents may not want the baby to sleep when they are feeding, but desire the baby to complete a full feeding. The lighting device provides a light show that arouses the baby and therefore is conducive to a thorough feeding, providing a further advantage over the prior art.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
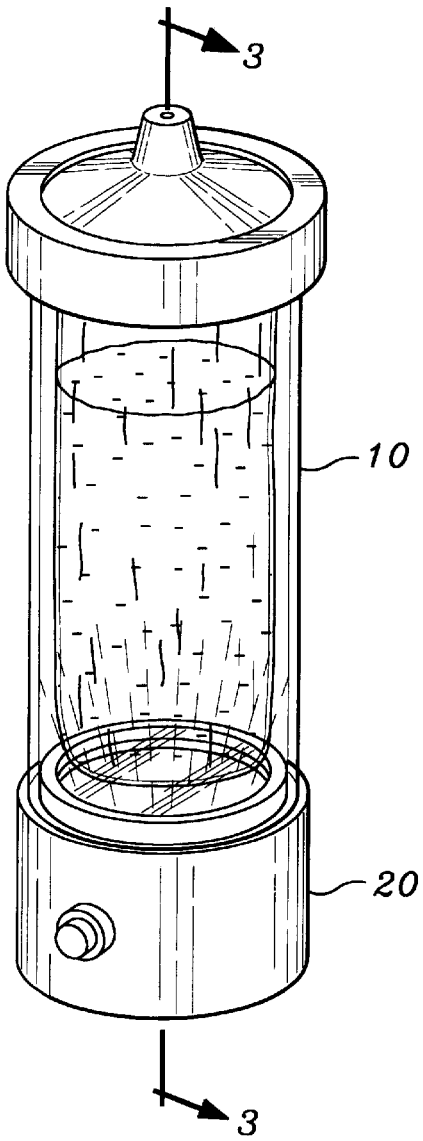
FIG. 1 is a perspective view of the preferred embodiment of the combination baby feeding bottle assembly and lighting device.
Figure 2:
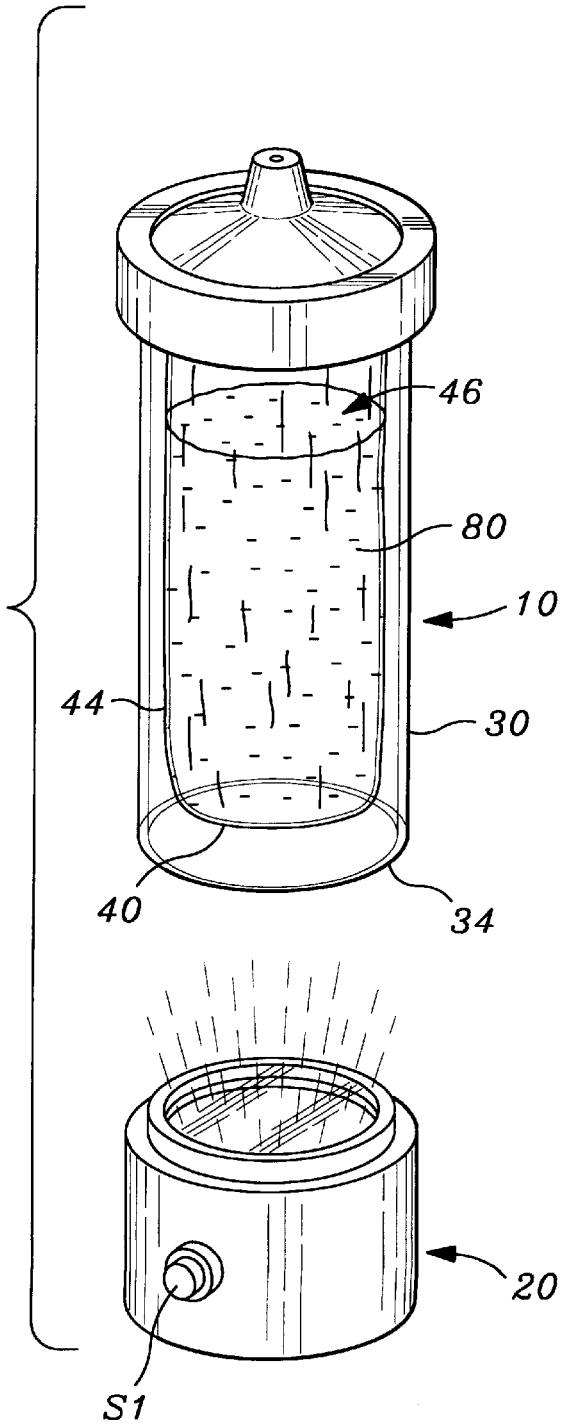
FIG. 2 is an exploded view of FIG. 1.
Figure 3A:
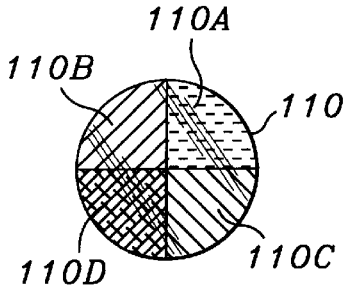
FIG. 3A is a disk for controlling the color of a light beam of the invention.
Figure 3B:
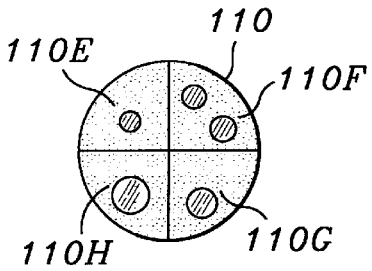
FIG. 3B is a disk for controlling the shape of a light beam of the invention.
Figure 3:
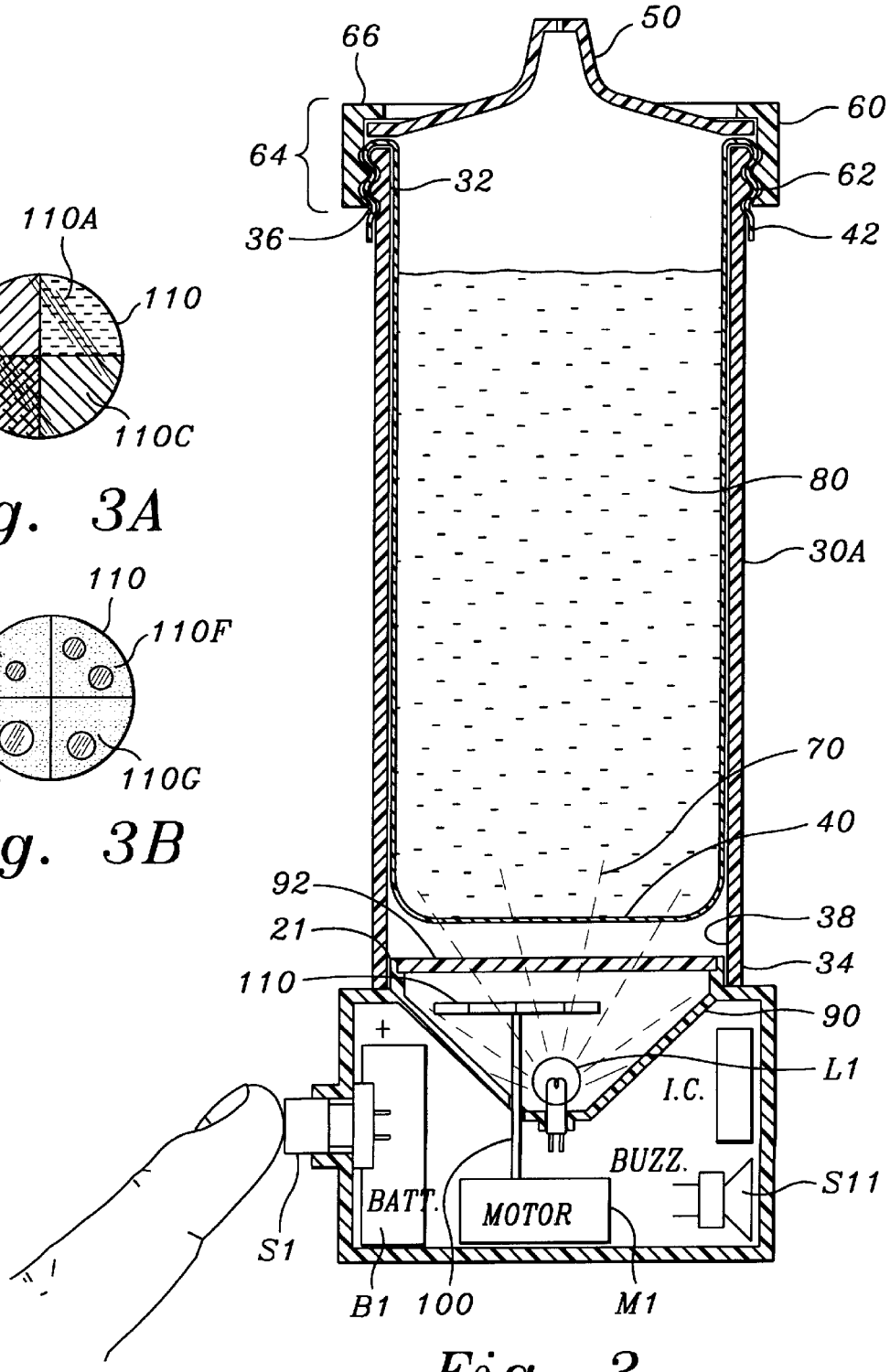
FIG. 3 is a sectional view of the combination taken along line 3—3 in FIG. 1.

The above described drawing figures illustrate the invention, a combination baby feeding bottle assembly 10 and amusement device 20. The baby bottle 10 is a common and well known type as broadly used today. It comprises a support portion 30 having a cylindrical shape with a sidewall 30A defining a first 32 and a second 34 open ends. FIG. 3, showing the assembly 10 in cross section which clearly defines the support portion 30 and its sidewall 30A. A bladder 40 typically constructed as a simple plastic, thin walled bag, is engaged within the support portion 30, the bladder providing an open lip portion 42, the open end of the bag, positioned over the first open end 32 of the sidewall 30A. A liquid holding portion 44 provides a space 46 for holding a liquid 80 within, typically milk, water or juice for a baby to consume. A drinking nipple 50 is mounted against the open lip portion 42 at the first open end 32 of the sidewall 30A. A bottle top portion 60 is engaged, by threaded engagement between internal threads 62 of the top portion 60 and external threads 36 of the sidewall 30A, for clamping both the nipple 50 and the bladder 40 against the first open end 32 of the support portion sidewall 30A.

The amusement device 20 is adapted for frictional, or snap-in engagement within the second of the open ends 34 of the support portion sidewall 30A. An annular lip 21 of the amusement device 20 is of such diameter as to fit frictionally into the interior of the sidewall 30A, i.e., as to be pressed in place and remain until removed. The fit between lip 21 and sidewall inner surface 38 may be alternately a threaded fit or a snap-in fit (not shown) as are well known other means for affixing such elements.

Figure 4:
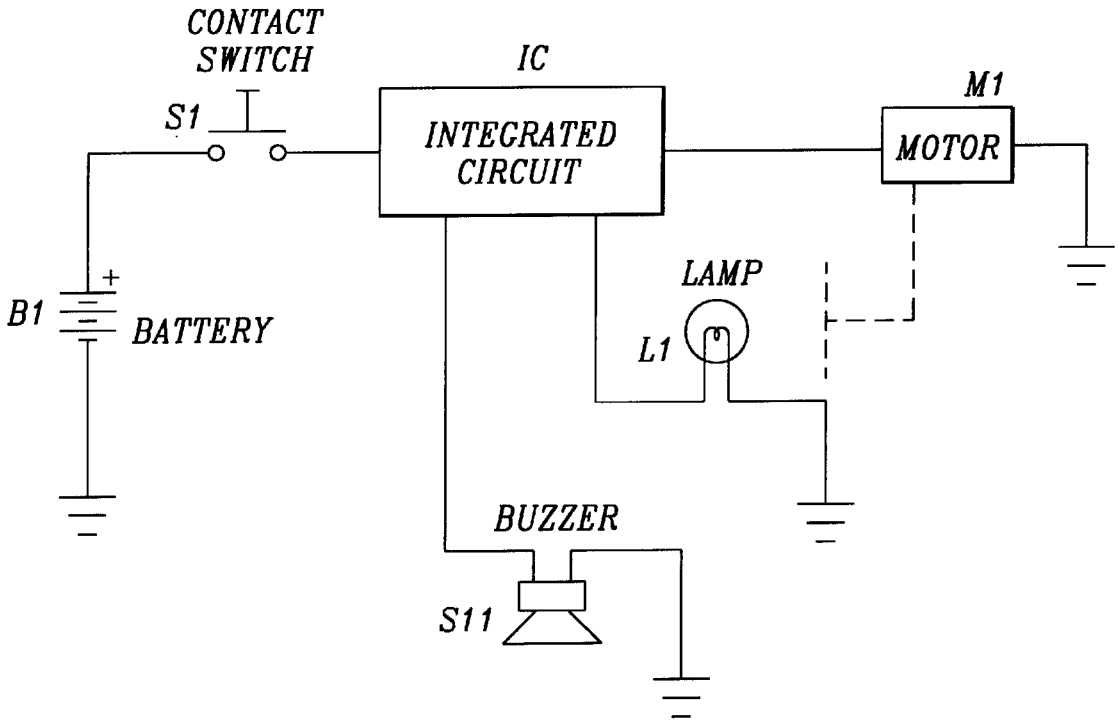
FIG. 4 is a schematic diagram depicting the electrical circuit controlling the invention.

Amusement device 20 is adapted for projecting a light beam 70 directed from the amusement device 20 into the liquid 80 within the bladder 40 for illumination of the liquid. Since the bladder 40 is preferably made of a transparent plastic, such a light beam 70 is able to progress, at least partially, through the liquid 80. The amusement device 20 preferably contains a flashlight of more-or-less standard construction and is positioned and adapted to project at least one light beam 70, but may include more than one light beam produced by separate light bulbs although only one is shown in FIG. 3. Now referring to FIG. 4, the invention includes a battery B1 interconnected through a contact switch S1 to an integrated circuit device IC. IC is further connected through lamp L1 to a return path or ground. Lamp L1 represents a single light source as shown in FIG. 3, or more than one light source as would be easily constructed in the circuit of FIG. 4 by one of skill in the art by positioning such multiple lamps in electrical series or parallel. IC functions, in this simple portion of the circuit enable illumination of L1 when S1 is manually closed. With L1 illuminated, light beam 70 is produced by reflector 90 and thereby projected through transparent lens 92 into baby bottle 10. IC includes a common timing circuit, well known in the art, so that the illumination brightness is varied with time, or may be turned on and off in a rhythmic fashion as desired. The variations of a lamp with time may take many forms but, in keeping with the spirit of the present invention, it is desired to adjust the brightness of the lamp in a more-or-less random fashion so as to keep the attention of the baby. Such a brightness adjusting circuit is well within the means of those skilled in the art of electrical circuit design, so that further details are not considered here. This circuit is just one portion of a means for changing 90 which is considered an important aspect of the present invention and is necessary in order to meet the objectives of the invention.

A further aspect of the changing means 90 which includes changes in color and shape of the beam 70. To achieve such further changes a motor, M1, preferably a micro-miniature DC electric motor is provided in the amusement device 20, providing a shaft 100 extending therefrom to support a color disk 110 in rotation thereof. Such a color disk 110 is well known in the art and is made of a transparent or translucent material such as a colored plastic or glass lens. The disk 110 may have a continuously variable density or color, or it may be segmented into pie-shaped segments 110A, 110B, 110C, 110D of different colors as shown in FIG. 3-A. In any case, the turning of such a disk in front of the lamp L1 causes the color of the beam 70 to vary. Such a disk 110, when divided into said segments, may also provide opaque and transparent portions in different shapes such as shown in FIG. 3-B as 110E, 110F, 110G, and 110H. Upon turning of such a disk in front of the lamp L1 causes the beam shape of the beam 70 to vary. Clearly, the characteristics of both the disks shown in FIGS. 3-A and 3-B could be combined to produce both color and shape changes in beam 70 simultaneously. The sound producing means S11 may be a buzzer as shown, or a miniature loudspeaker or other sound producing device. Under the control of IC, S11 is able to produce random buzzing sounds, tunes or other recognizable sounds. IC may be programmed, as is known in the art, with a solid state memory device for storing one or more recognizable tunes. Alternately, a randomly variable noise may be produced. It is seen, in the above description, that IC provides several common and well known circuits for random brightness variations of L1, for rotation of M1 to position disk 92 in a random manner in front of lamp L1, and for producing random variations in sound produced by S11. In this manner, the present invention is able to meet the objectives of amusing a baby during the feeding process as described in the summary above.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination baby feeding bottle and amusement device comprising:

a baby feeding bottle assembly comprising:

i) a support portion having a cylindrical shape with a sidewall defining a first and a second open ends thereof;

ii) a bladder engaged within the support portion, the bladder providing an open lip portion positioned over the first open end of the sidewall, and a liquid holding portion providing a space for holding a liquid therewithin;

iii) a drinking nipple mounted against the open lip portion at the first open end of the support portion;

iv) a bottle top portion engaged with the support portion for clamping the nipple and the bladder against the support portion; and an amusement device adapted for frictional engagement with the second of the open ends of the support portion sidewall such that an annular lip of the amusement device is of such diameter as to fit frictionally into the interior of the sidewall so as to be pressed in place and remain until forcefully removed, a light beam generating means therein projecting at least one light beam into the liquid within the bladder for illumination thereof.

2. The combination of claim 1 wherein the amusement device includes a flashlight.

3. The combination of claim 2 wherein the flashlight is adapted to project at least one beam of light, and further includes a means for changing the color of the at least one beam of light.

4. The combination of claim 2 wherein the flashlight is adapted to project at least one beam of light, and further includes a means for changing the intensity of the at least one beam of light.

5. The combination of claim 2 wherein the flashlight is adapted to project at least one beam of light, and further includes a means for changing the shape of the at least one beam of light.

6. The combination of claim 2 wherein the flashlight is adapted to project at least one beam of light, and further including a means for changing the color and the shape of the at least one beam of light.

7. The combination of claim 6 wherein the changing means provides a means for adapting the changes of the color and shape of the at least one beam of light in a manner continuous with time.

8. The combination of claim 2 wherein the flashlight further includes a means for periodic interruption of the light beam.

9. The combination of claim 1 wherein the amusement device further includes a sound producing means.

10. An amusement device for use with a baby bottle, the device comprising:

a housing adapted for engagement with the baby bottle, the housing providing a light beam generating means therein projecting at least one light beam into a liquid within the baby bottle for illumination thereof;

a means for changing the color of the at least one beam of light;

an annular lip of the amusement device of such diameter as to fit frictionally into the interior of a sidewall of the baby bottle enabling the amusement device to be pressed in place in the baby bottle and remain until forcefully removed.

11. The device of claim 10 wherein the generating means further includes a means for changing the intensity of the at least one beam of light.

12. The device of claim 10 wherein the generating means further includes a means for changing the shape of the at least one beam of light.

13. The device of claim 10 wherein the generating means further includes a means for changing the shape and intensity of the at least one beam of light.

14. The device of claim 13 wherein the generating means further includes a means for changing the color, shape and intensity of the at least one beam of light with respect to time.

15. The device of claim 10 further including a sound producing means.

* * * * *